US008672461B2

(12) United States Patent
Igarashi

(10) Patent No.: US 8,672,461 B2
(45) Date of Patent: Mar. 18, 2014

(54) LIQUID EJECTION APPARATUS

(75) Inventor: Akinori Igarashi, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/191,012

(22) Filed: Jul. 26, 2011

(65) Prior Publication Data

US 2012/0026220 A1 Feb. 2, 2012

(30) Foreign Application Priority Data

Jul. 30, 2010 (JP) ..... 2010-172236

(51) Int. Cl.
*B41J 2/17* (2006.01)

(52) U.S. Cl.
USPC ..... 347/84; 347/92; 347/7

(58) Field of Classification Search
USPC ..... 347/7, 84, 95, 89, 5, 92
See application file for complete search history.

(56) References Cited

U.S. PATENT DOCUMENTS

| | | | | |
|---|---|---|---|---|
| 7,841,706 | B2 * | 11/2010 | Ishinaga et al. | 347/84 |
| 2008/0158307 | A1 | 7/2008 | Nitta et al. | |
| 2009/0002467 | A1 | 1/2009 | Watanabe | |

FOREIGN PATENT DOCUMENTS

| | | | |
|---|---|---|---|
| CN | 1775529 | A | 5/2006 |
| CN | 1970303 | A | 5/2007 |
| CN | 101332714 | A | 12/2008 |
| EP | 0 903 235 | A2 | 3/1999 |
| EP | 1 533 126 | A1 | 5/2005 |
| EP | 1 790 482 | A2 | 5/2007 |
| EP | 2 153 998 | A2 | 2/2010 |
| JP | 10-230203 | A | 9/1998 |
| JP | 2005-342961 | A | 12/2005 |
| JP | 2009-29111 | | 2/2009 |
| JP | 2009-285845 | A | 12/2009 |

OTHER PUBLICATIONS

Extended European Search Report dated Oct. 27, 2011 from related European Patent Application 11175398.4.
Notification of Reason for Refusal dated Sep. 3, 2013 from counterpart Japanese Application No. 2010-172236, together with an English language translation.
Notification of the First Office Action dated Sep. 2, 2013 from counterpart Chinese Application No. 201110214622.0, together with an English language translation.

* cited by examiner

*Primary Examiner* — Lam S Nguyen
(74) *Attorney, Agent, or Firm* — Scully, Scott, Murphy & Presser, P.C.

(57) ABSTRACT

A liquid ejection apparatus including: a liquid ejection head including: an inlet opening; an outlet opening; an inside channel; and ejection openings; a tank; a supply channel; a return channel; a supply device; and a controller, wherein the controller is configured to control the supply device to perform a circulating operation in which the liquid in the tank is transferred to the supply channel, the inside channel, and the return channel in order and returns to the tank, and wherein the controller is configured to control the supply device such that a unit-time supply amount that is an amount of the liquid to be supplied to the inside channel per unit time in a first period in the circulating operation is less than that in a second period that is after the first period.

16 Claims, 11 Drawing Sheets

LIQUID EJECTION APPARATUS

CROSS REFERENCE TO RELATED APPLICATION

The present application claims priority from Japanese Patent Application No. 2010-172236, which was filed on Jul. 30, 2010, the disclosure of which is herein incorporated by reference in its entirety.

BACKGROUND OF THE INVENTION

1. Field of the Invention

The present invention relates to a liquid ejection apparatus configured to eject liquid from ejection openings.

2. Description of the Related Art

There is known an ink-jet head configured to eject ink droplets from a plurality of ejection openings and having a circulation passage formed therein for circulating the ink between an ink tank and ink channels of the ink-jet head, the ink-jet head being configured to remove air bubbles and foreign matters remaining in ink channels by feeding the ink in the ink tank to the ink channels at a specific pressure by a pump to circulate the ink in the circulation passage.

SUMMARY OF THE INVENTION

In the above-described technique, the ink is fed to the ink channels at the specific (constant) pressure. Thus, in some shapes and arrangements of the ink channels, the air bubbles and the foreign matters staying in the ink channels cannot be carried by the ink flow toward a downstream side of the channels. Further, a pattern of the ink flow rarely changes during the circulation in the above-described technique, which may cause the air bubbles and the foreign matters to stay in "dead water" areas formed in the ink channels in which the ink does not flow. In this case, it is difficult to carry the remaining air bubbles and foreign matters by the ink flow.

This invention has been developed in view of the above-described situations, and it is an object of the present invention to provide a liquid ejection apparatus configured to efficiently remove air bubbles and foreign matters from channels formed in a liquid ejection head.

The object indicated above may be achieved according to the present invention which provides a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channel branched from the inside channel; a tank storing the liquid to be supplied to the liquid ejection head; a supply channel communicating the tank and the inlet opening with each other; a return channel communicating the tank and the outlet opening with each other; a supply device configured to supply the liquid in the tank to the inside channel via the supply channel; and a controller configured to control the supply device, wherein the controller is configured to control the supply device to perform a circulating operation in which the liquid in the tank is transferred to the supply channel, the inside channel, and the return channel in order and returns to the tank, and wherein the controller is configured to control the supply device such that a unit-time supply amount that is an amount of the liquid to be supplied to the inside channel per unit time in a first period in the circulating operation is less than that in a second period that is after the first period.

In the liquid ejection apparatus constructed as described above, for the first period for which the circulating operation is started, the unit-time supply amount is set at a relatively small amount to gather air bubbles and foreign matters scattered in corner parts of the inside channel to a main stream of the circulation in the inside channel, and then the unit-time supply amount is increased during the second period to accelerate a liquid flow, thereby moving the air bubbles and the foreign matters gathered in the main stream by and on the accelerated flow to discharge the air bubbles and the foreign matters to an outside of the apparatus. As a result, even if the inside channel has complicated constructions and arrangements, it is possible to efficiently remove the air bubbles and the foreign matters remaining in the channel.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
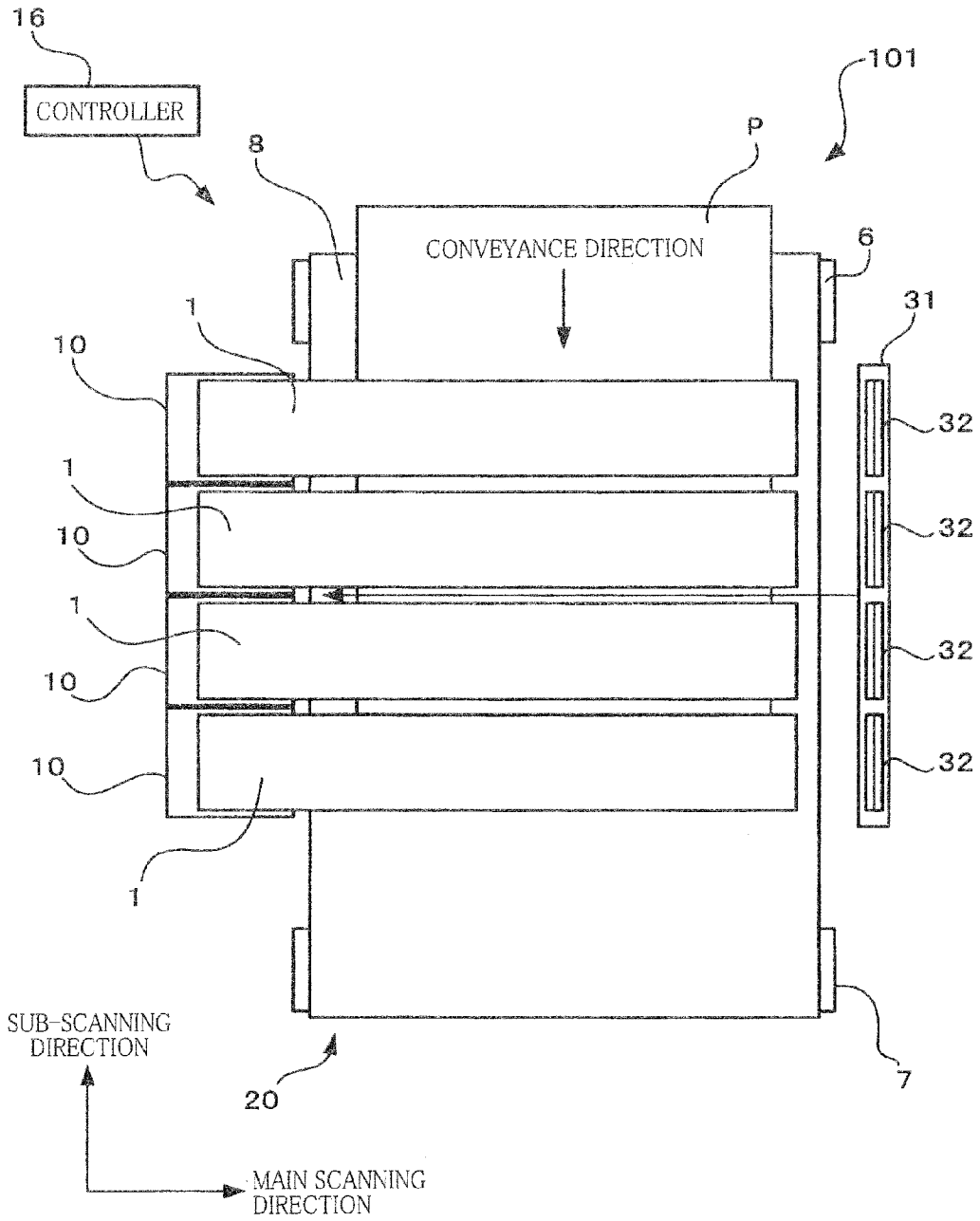
FIG. 1 is a plan view generally showing an ink-jet printer as one embodiment of the present invention.

As shown in FIG. 1, an ink-jet printer 101 as one example of a liquid ejection apparatus includes: (a) a sheet conveyance unit 20 configured to convey a sheet P from an upper side toward a lower side in FIG. 1; (b) four ink-jet heads 1 (each as one example of liquid ejection head) configured to eject droplets of inks of respective four colors, namely, black, magenta, cyan, and yellow onto the sheet P conveyed by the conveyance unit 20; four ink supply units 10 configured to respectively supply the inks to the ink-jet heads 1; a maintenance unit 31 configured to perform a maintenance for ink-jet heads 1; and a controller 16 configured to control entire operations of the ink-jet printer 101. It is noted that, in the present embodiment, a sub-scanning direction is a direction parallel to a conveyance direction in which the conveyance unit 20 conveys the sheet P, and a main scanning direction is a direction perpendicular to the sub-scanning direction and along a horizontal plane.

The conveyance unit 20 includes two belt rollers 6, 7 and an endless sheet conveyance belt 8 wound around the rollers 6, 7. The belt roller 7 is a drive roller that is rotated by a drive power from a conveyance motor, not shown. The belt roller 6 is a driven roller that is rotated in accordance with the running or rotation of the conveyance belt 8 which is caused by the rotation of the belt roller 7. The sheet P placed on an outer circumferential face of the conveyance belt 8 is conveyed toward the lower side in FIG. 1.

The four ink-jet heads 1 each extends in the main scanning direction and are disposed in parallel with one another in the sub-scanning direction. That is, the ink-jet printer 101 is a line-type color ink-jet printer in which a plurality of ejection openings 108 through which the ink droplets are ejected are arranged in the main scanning direction. A lower face of each ink-jet head 1 functions as an ejection face 2*a* in which the plurality of the ejection openings 108 are formed (see FIGS. 2-4).

An outer circumferential face of an upper portion of the conveyance belt 8 and the ejection faces 2*a* face and parallel with each other. When the sheet P conveyed on the conveyance belt 8 passes through positions just under the four ink-jet heads 1, the ink droplets of four colors are ejected in order from the respective ink-jet heads 1 onto an upper face of the sheet P, whereby a desired color image is formed on the sheet P.

Each of the ink supply units 10 is connected to a left end portion of the lower face of a corresponding one of the ink-jet heads 1 in FIG. 1 so as to supply the ink to the corresponding ink-jet head 1.

The maintenance unit 31 includes four wiper members 32. Each of the wiper members 32 is an elastic member for wiping the ejection face 2*a* of a corresponding one of the ink-jet heads 1 in a wiping operation of a maintenance operation which will be described below. Each wiper member 32 is reciprocable by an actuator, not shown, in the main scanning direction (indicated by an arrow in FIG. 1).

Figure 2:
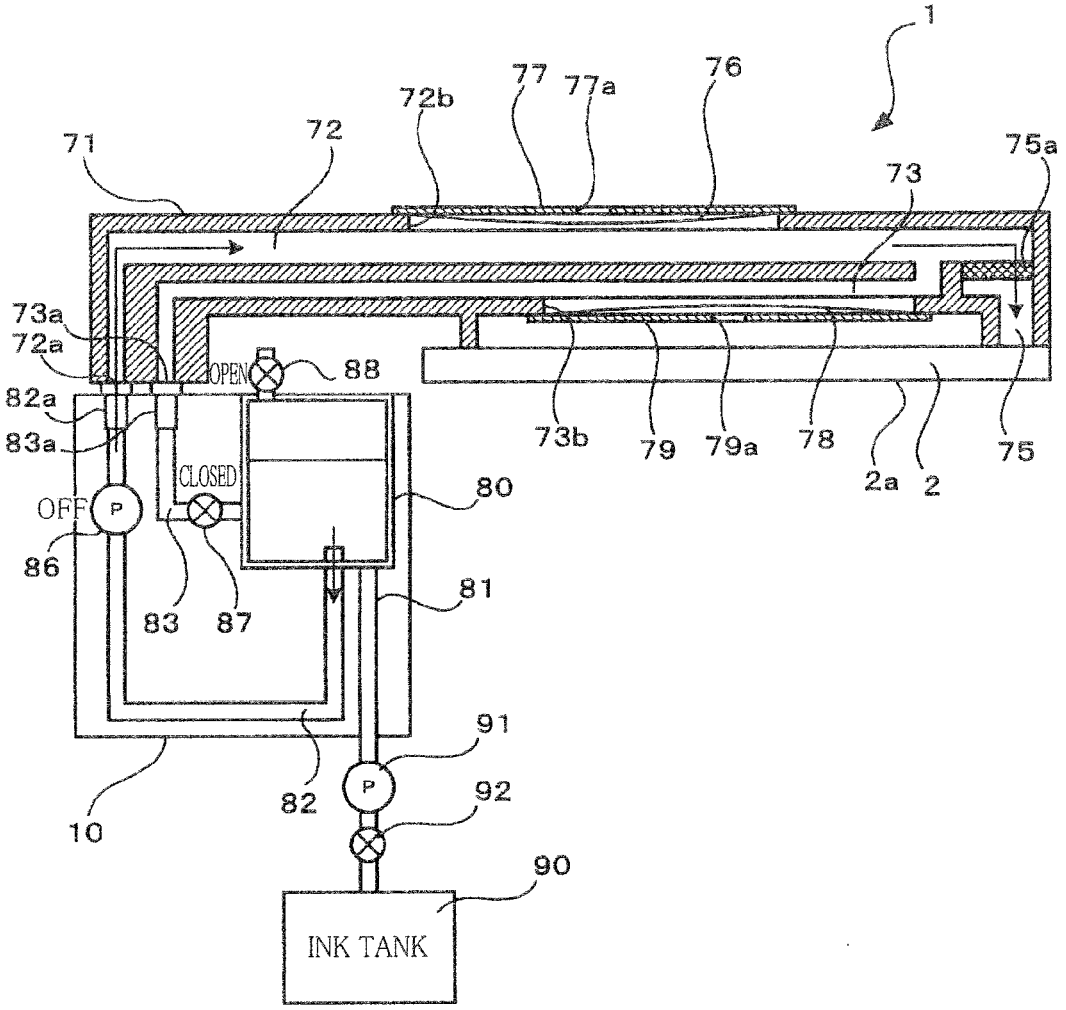
FIG. 2 is a cross-sectional view showing an ink-jet head and an ink supply unit shown in FIG. 1.

There will be next explained the ink-jet heads 1 in detail with reference to FIG. 2. As shown in FIG. 2, each ink-jet head 1 includes a reservoir unit 71 and a head main body 2.

The reservoir unit 71 is a channel defining member that is fixed to an upper face of the head main body 2 and supplies the ink to the head main body 2. The reservoir unit 71 has an ink inlet channel 72 (as one example of an inside channel), ten ink outlet channels 75, and a discharge channel 73 (as another example of an inside channel) formed therein. It is noted that only a single ink outlet channel 75 is shown in FIG. 2.

The ink inlet channel 72 is a channel into which the ink from the ink supply unit 10 flows via an inlet opening 72*a* opened in a lower face of the reservoir unit 71. The ink inlet channel 72 functions as an ink reservoir for temporarily storing the flowed ink. In an inner wall face of the ink inlet channel 72, there is formed a hole 72*b* formed through an outer wall face of the reservoir unit 71. The hole 72*b* is sealed by a flexible resin film 76 from a side of the hole 72*b* which is nearer to the outer wall face of the reservoir unit 71. That is, the resin film 76 partly constitutes the inner wall face of the ink inlet channel 72. The resin film 76 is displaced according to changes of a pressure of the ink in the ink inlet channel 72, functioning as a damper for restraining the changes of the ink pressure. Using the resin film 76 enables to provide the damper at low cost. It is noted that, in a normal recording, the resin film 76 slightly projects toward an inside of the ink inlet channel 72. To the outer wall face of the reservoir unit 71 is fixed a plate-like restraining member 77 so as to cover the hole 72*b*, thereby restraining the resin film 76 from projecting toward an outside of the reservoir unit 71. As a result, it is possible to prevent the resin film 76 from being broken by being excessively displaced when the ink pressure in the ink inlet channel 72 becomes excessively high. In the restraining member 77 is formed an air communicating hole 77*a* that always keeps a pressure between the restraining member 77 and the resin film 76 at an atmospheric pressure. This facilitates the displacement of the resin film 76.

Figure 3:
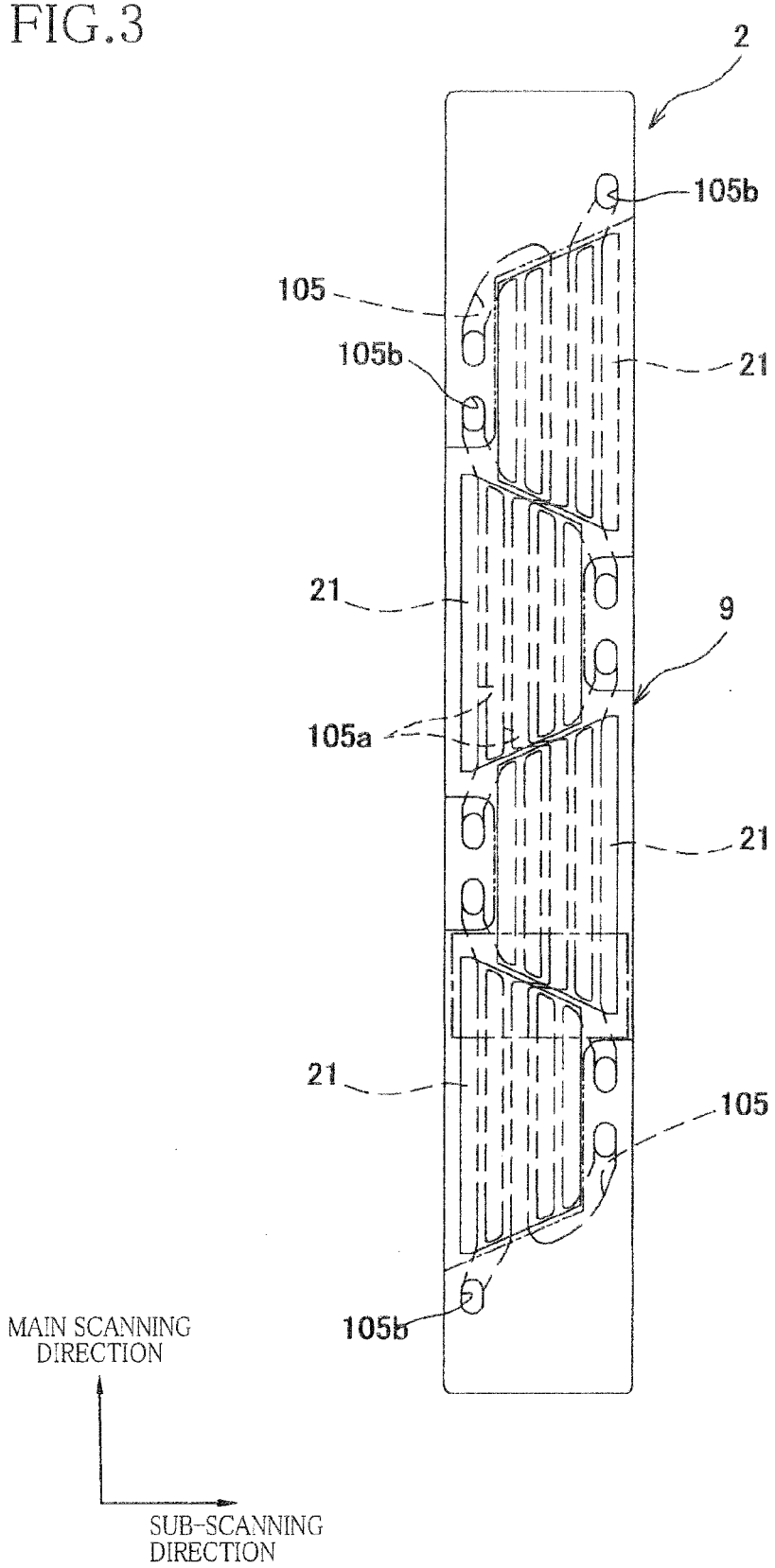
FIG. 3 is a plan view showing a head main body shown in FIG. 2.

The ink outlet channels 75 communicate with the ink inlet channel 72 via a filter 75*a* and with ink supply openings 105*b* formed in an upper face of a channel unit 9 (see FIG. 3). The filter 75*a* extends in a direction in which the ink flows in the ink inlet channel 72 (i.e., in the rightward and leftward direction in FIG. 2). In the normal recording, the ink supplied from the ink supply unit 10 flows into the ink inlet channel 72, then passes through the ink outlet channels 75, and finally is supplied from the ink supply openings 105*b* to the channel unit 9.

The discharge channel 73 communicates with the ink inlet channel 72 at a portion thereof located on an upstream side of the filter 75*a* and is connected to the ink supply unit 10 via an outlet opening 73*a* formed in the lower face of the reservoir unit 71.

In a lower inner wall face of the discharge channel 73, there is formed a hole 73*b* formed through the outer wall face of the reservoir unit 71. The hole 73*b* is sealed by a flexible resin film 78 from a lower side of the hole 73*b*, i.e., from a side of the hole 73*b* which is nearer to the outer wall face of the reservoir unit 71. That is, the resin film 78 partly constitutes the inner wall face of the discharge channel 73. The resin film 78 is displaced according to changes of a pressure of the ink in the discharge channel 73, functioning as a damper for restraining the changes of the ink pressure. Using the resin film 78 enables to provide the damper at low cost. It is noted that, in the normal recording, the resin film 78 slightly projects toward an inside of the discharge channel 73. To the lower outer wall face of the reservoir unit 71 is fixed a plate-like restraining member 79 so as to cover the hole 73*b*, thereby restraining the resin film 78 from projecting toward an outside of the reservoir unit 71. As a result, it is possible to prevent the resin film 78 from being broken by being excessively displaced when the ink pressure in the discharge channel 73 becomes excessively high. In the restraining member 79 is formed an air communicating hole 79*a* that always keeps a pressure between the restraining member 79 and the resin film 78 at the atmospheric pressure. This facilitates the displacement of the resin film 78. In ink circulation which will be described below, the ink supplied from the ink supply unit 10 flows into the ink inlet channel 72 via the inlet opening 72*a*, then passes from the ink inlet channel 72 through the discharge channel 73, and finally returns to the ink supply unit 10 via the outlet opening 73*a* (see FIG. 9).

Figure 4:
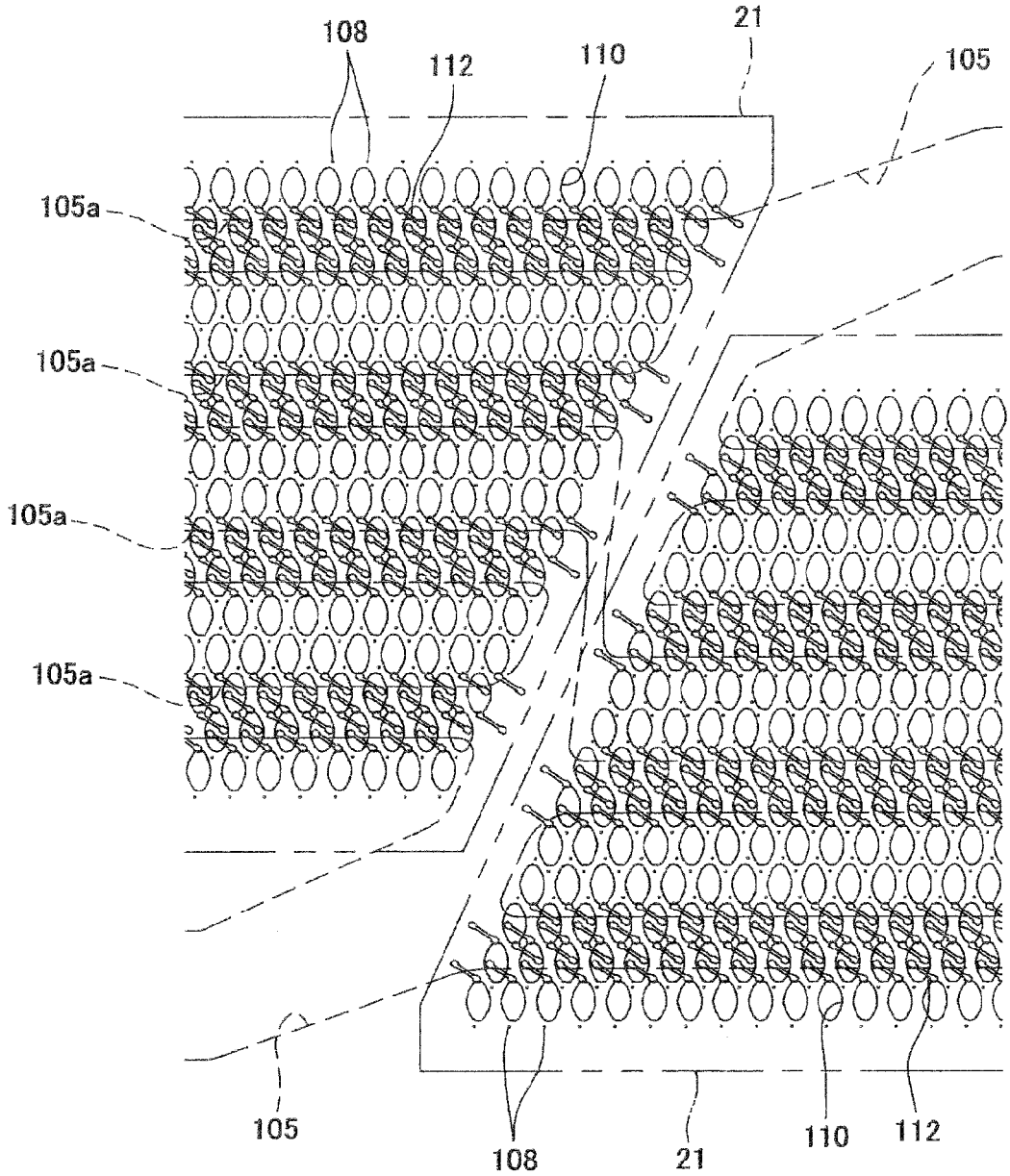
FIG. 4 is an enlarged view showing an area enclosed by a one-dot chain line shown in FIG. 3.
Figure 5:
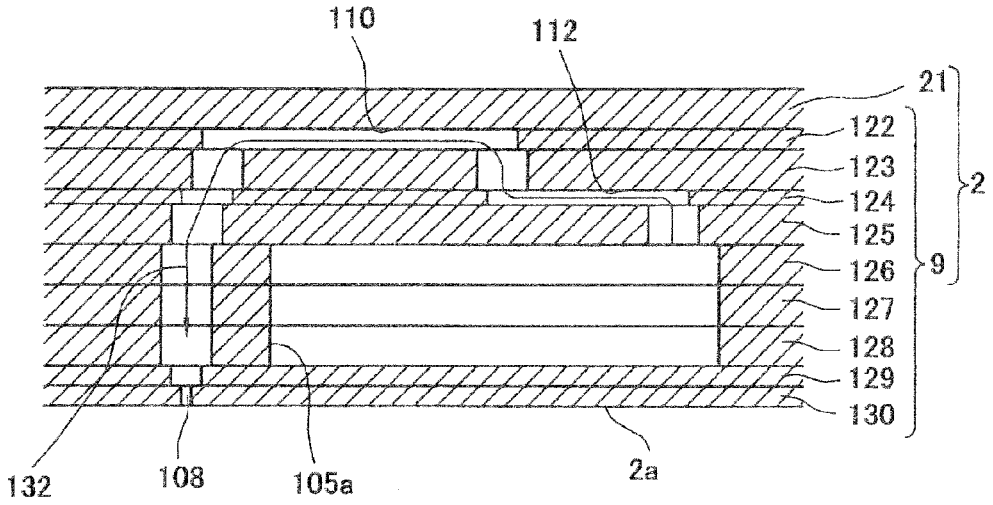
FIG. 5 is a partial cross-sectional view showing the ink-jet head shown in FIG. 4.

There will be next explained the head main body 2 in more detail with reference to FIGS. 3-5. It is noted that, in FIG. 4, pressure chambers 110, apertures 112, and the ejection openings 108 are illustrated by solid lines for easier understanding purposes though these elements should be illustrated by broken lines because these elements are located under actuator units 21.

As shown in FIGS. 3-5, the head main body 2 includes the channel unit 9 and the four actuator units 21 fixed to the upper face of the channel unit 9. The channel unit 9 has ink channels including the pressure chambers 110 and so on. The actuator units 21 include a plurality of unimorph actuators respectively corresponding to the pressure chambers 110 so as to selectively apply ejection energy to the ink in the pressure chambers 110.

The channel unit 9 is a stacked body constituted by a plurality of metal plates 122-130 formed of stainless steel and positioned and stacked on each other. The upper face of the channel unit 9 has the ten ink supply openings 105*b* opened therein which communicate respectively with the ink outlet channels 75 of the reservoir unit 71 (see FIG. 2). As shown in FIG. 3, in the channel unit 9 are formed a plurality of manifold channels 105 and a plurality of sub-manifold channels 105*a*. Each of the ink supply openings 105*b* communicates with a corresponding one of the manifold channels 105, and each of the sub-manifold channels 105*a* is included in a corresponding one of the manifold channels 105. Further, as shown in FIG. 5, in the channel unit 9 is formed a plurality of individual ink channels 132 each branched from a corresponding one of the sub-manifold channels 105*a* and extending to a corresponding one of the ejection openings 108 opened in the ejection face 2*a* via a corresponding one of the pressure chambers 110. In the ejection face 2*a*, the ejection openings 108 are formed in matrix.

There will be next explained flow of the ink in the channel unit 9. As shown in FIGS. 3-5, in the normal recording, the ink supplied from the ink outlet channels 75 of the reservoir unit 71 to the ink supply openings 105*b* is distributed to the sub-manifold channels 105*a* of the manifold channels 105. The ink in the sub-manifold channels 105*a* flows into the individual ink channels 132 including the respective apertures 112 and the respective pressure chambers 110 and reaches the respective ejection openings 108 through the respective individual ink channels 132.

There will be next explained the ink supply unit 10 in detail. As shown in FIG. 2, each ink supply unit 10 includes: (a) a sub-tank 80; (b) an ink replenish tube 81 connected to the sub-tank 80; (c) a replenish pump 91 and a replenish valve 92 provided on the ink replenish tube 81; (d) an ink supply tube 82 as one example of a supply channel and an ink returning tube 83 as one example of a return channel; (e) a purging pump 86 (as one example of a supply device) provided on the ink supply tube 82; (f) a circulation valve 87 provided on the ink returning tube 83; and (g) an air communicating valve 88 connected to the sub-tank 80.

The sub-tank 80 is for storing the ink to be supplied to the ink-jet head 1. When an amount of the ink in the sub-tank 80 becomes small, the replenish valve 92 is opened and the replenish pump 91 is driven, thereby replenishing the ink stored in an ink tank 90 to the sub-tank 80 via the ink replenish tube 81. The air communicating valve 88 communicates, in its open state, an inside of the sub-tank 80 with an ambient air or interrupts, in its closed state, the communication of the sub-tank 80 with the ambient air. In the normal recording, the air communicating valve 88 is open, so that the inside of the sub-tank 80 and the ambient air communicate with each other. As a result, an air pressure in the sub-tank 80 is always kept at an atmospheric pressure regardless of the amount of the ink stored in the sub-tank 80, ensuring stable ink supply.

One end of the ink supply tube 82 is connected to the sub-tank 80, and the other end thereof is connected to the inlet opening 72*a* of the reservoir unit 71 via a joint 82*a*. Thus, the ink in the sub-tank 80 is supplied to the ink inlet channel 72 of the reservoir unit 71 via the ink supply tube 82. The purging pump 86 functions as a supply portion which is driven to forcibly supply the ink in the sub-tank 80 to the ink inlet channel 72 via the ink supply tube 82. Further, the purging pump 86 functions as a check valve which prevents the ink from flowing from the joint 82*a* toward the sub-tank 80 in the ink supply tube 82. It is noted that, even where the purging pump 86 is stopped, the ink in the sub-tank 80 can be supplied to the reservoir unit 71 by flowing through the ink supply tube 82.

Figure 6:
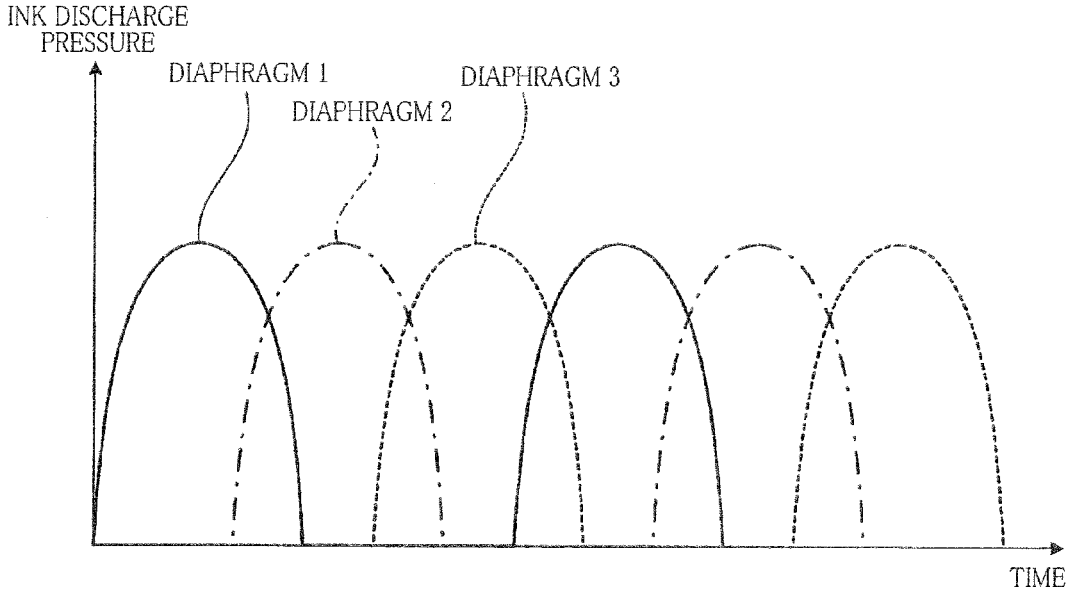
FIG. 6 is a graph showing operational characteristics of a purging pump shown in FIG. 2.

The purging pump 86 is a motorized three-phase diaphragm pump as a volume pump, and as shown in FIG. 6, three diaphragms are driven in different phases to discharge the ink, thereby restraining a pressure variation upon the ink supply. Further, by changing an electric power to be applied to the purging pump 86, it is possible to control an amount of the ink to be supplied from the purging pump 86 to the ink inlet channel 72 per unit time (hereinafter may be referred to as "unit-time supply amount").

As shown in FIG. 2, one end of the ink returning tube 83 is connected to the sub-tank 80, and the other end thereof is connected to the outlet opening 73*a* of the reservoir unit 71 via a joint 83*a*. The circulation valve 87 is an adjustment device configured to adjust a channel resistance value of the ink returning tube 83 between a predetermined minimum value (in an open state of the circulation valve 87) and a predetermined maximum value (in a closed state of the circulation valve 87). It is noted that, in the present embodiment, the circulation valve 87 is an open-and-close valve for changing between (a) its open state in which the flow of the ink is not interrupted at all and (b) its closed state in which the flow of the ink is completely interrupted or inhibited, but the circulation valve 87 may be a resistance controlling valve capable of adjusting the channel resistance value at any value.

Figure 7:
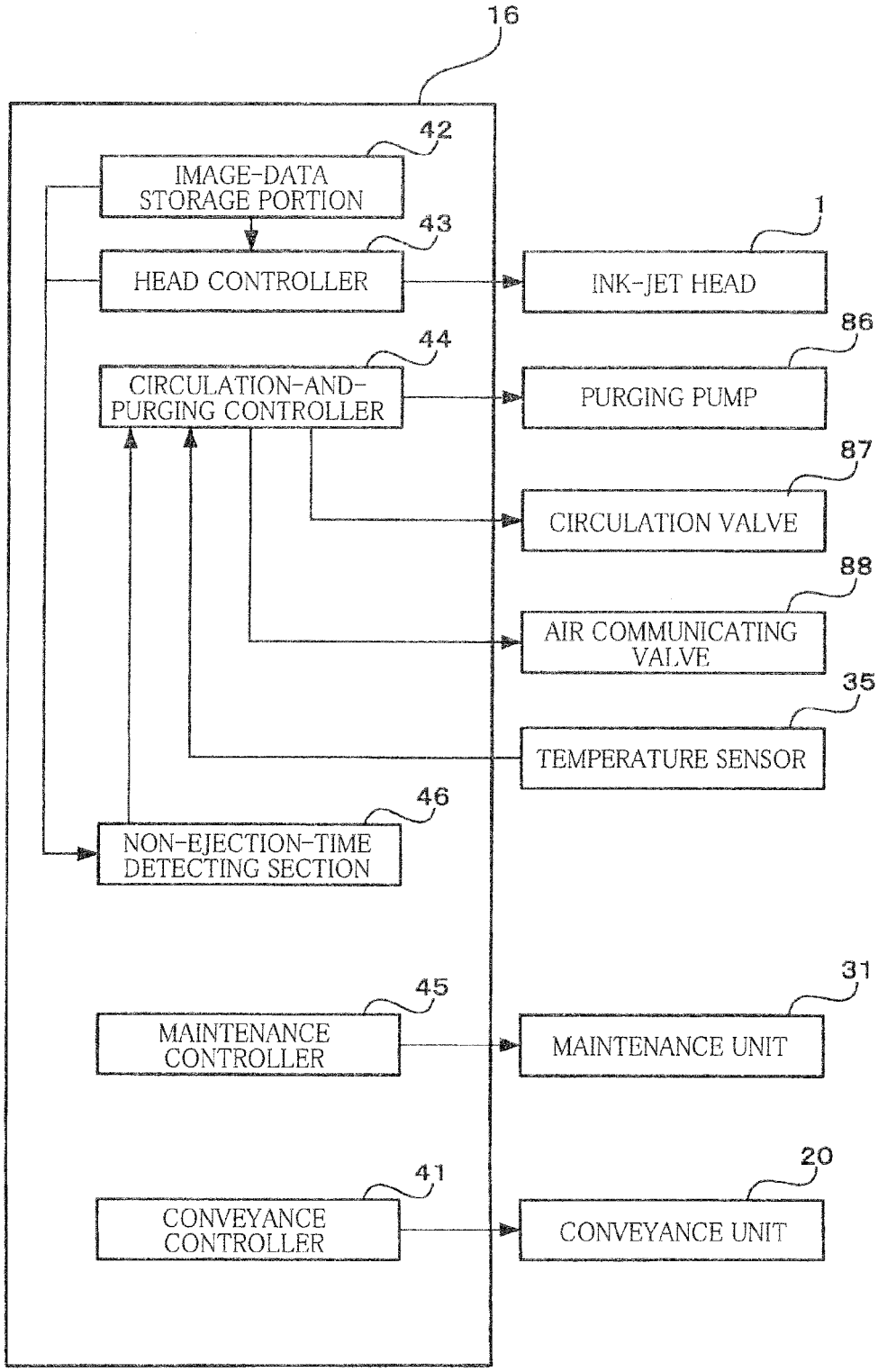
FIG. 7 is a functional block diagram of a controller shown in FIG. 1.

There will be next explained the controller 16 with reference to FIG. 7. The controller 16 includes: a Central Processing Unit (CPU); an Electrically Erasable and Programmable Read Only Memory (EEPROM) that rewritably stores programs to be executed by the CPU and data used for the programs; and a Random Access Memory (RAM) that temporarily stores data when the program is executed. The controller 16 includes various functioning sections which are constituted by cooperation of these hardwares and softwares in the EEPROM with each other. The controller 16 is configured to control entire operations of the ink-jet printer 101 and includes: a conveyance controller 41; an image-data storage portion 42; a head controller 43; a non-ejection-time detecting section 46; a circulation-and-purging controller 44; and a maintenance controller 45.

The conveyance controller 41 controls the conveyance motor of the conveyance unit 20 such that the sheet P is conveyed in the conveyance direction at a predetermined speed. The image-data storage portion 42 stores therein image data relating to an image to be recorded on the sheet P.

Figure 8:
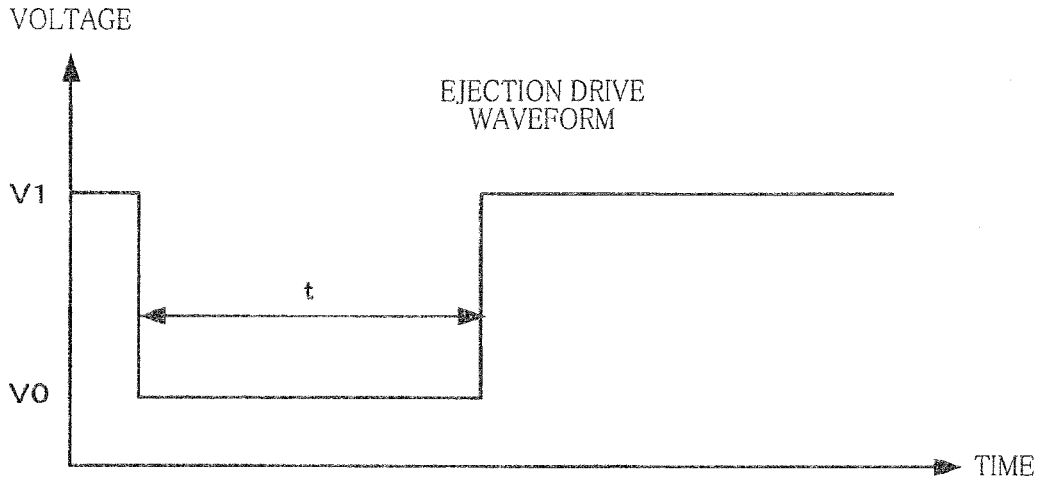
FIG. 8 is a waveform chart of an ejection driving signal produced by a head controller shown in FIG. 7.

In the normal recording, the head controller 43 produces an ejection driving signal on the basis of the image data and supplies the produced ejection driving signal to the actuator units 21. As shown in FIG. 8, the ejection driving signal is a signal including a pulse that changes from an electric potential V1 to a ground potential V0 for a predetermined length of time in a single recording cycle. This pulse width t is equal to a length of time in which a pressure wave is transmitted through a distance AL (Acoustic Length) extending from an outlet of the sub-manifold channel 105*a* to the ejection opening 108. It is noted that a waveform in FIG. 8 is a waveform corresponding to ejection of a small ink droplet and having a single pulse. A waveform corresponding to a medium-size ink droplet is constituted by successive two pulses, and a waveform corresponding to a large ink droplet is constituted by successive three pulses.

On the basis of an ink ejection history, the non-ejection-time detecting section 46 detects, for each ink-jet head 1, an elapsed time from the last (most recent) ejection of the ink droplet from the ejection opening 108 to a current time. Specifically, the non-ejection-time detecting section 46 detects the elapsed time on the basis of the ejection driving signal outputted from the head controller 43 or the data stored in the image-data storage portion 42.

In the maintenance operation which will be described below, the circulation-and-purging controller 44 controls operations of the purging pump 86, the circulation valve 87, and the air communicating valve 88 of each ink supply unit 10. It is noted that the circulation-and-purging controller 44 controls the unit-time supply amount of the purging pump 86 by changing the electric power applied to the purging pump 86. Specific controls of the circulation-and-purging controller 44 will be described below. It is noted that the circulation-and-purging controller 44 also controls the replenish pump 91 and the replenish valve 92 for the ink replenishing, but these are omitted in FIG. 7.

The maintenance controller 45 controls the maintenance unit 31 in the maintenance operation which will be described below.

There will be next explained the maintenance operation with reference to FIGS. 9-12. The maintenance operation is an operation for performing the maintenance of the ink-jet heads 1 and is started when the ink-jet printer 101 is booted up, when a standby time during which the recording has not been performed has passed a specific length of time, and when a command is inputted by a user, for example. During the standby state and the normal recording, the purging pump 86 is stopped (the unit-time supply amount=0: V0), the circulation valve 87 is closed, the air communicating valve 88 is open, the replenish pump 91 is stopped, and the replenish valve 92 is closed (see FIG. 2).

Figure 9:
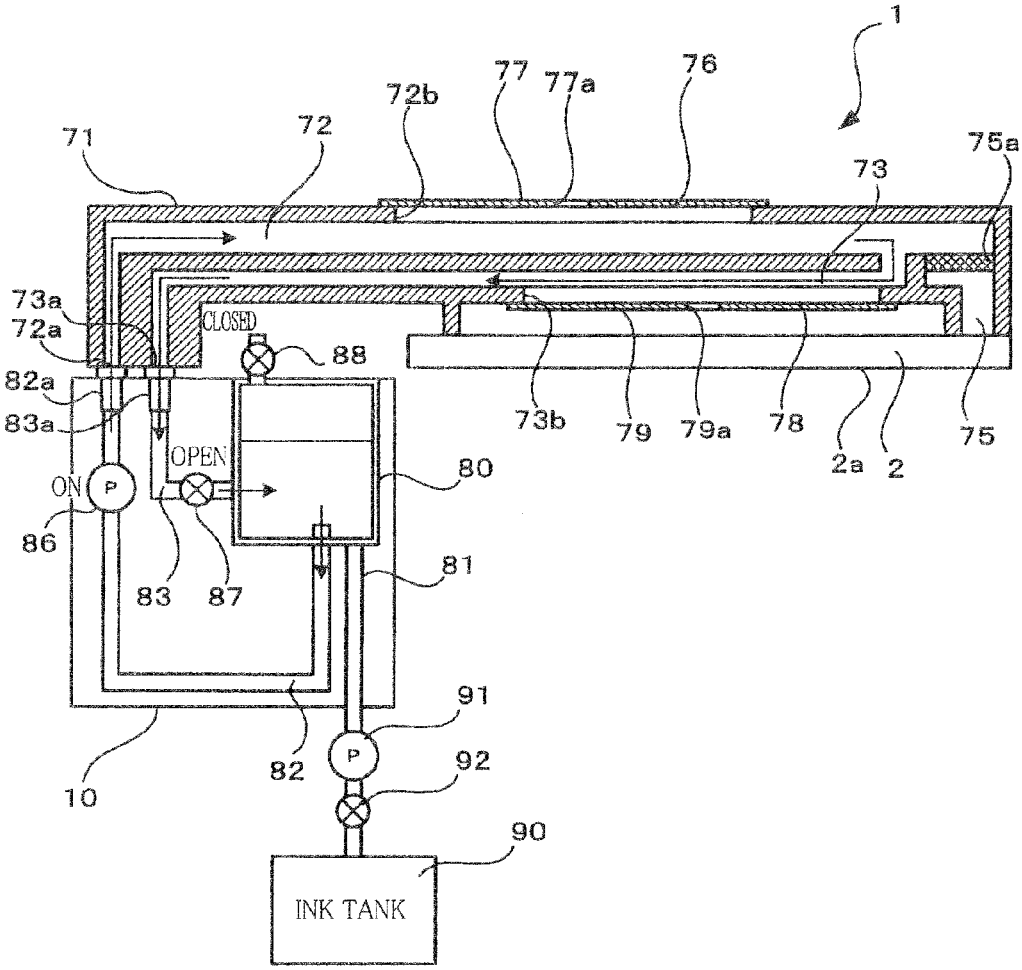
FIG. 9 is a view showing a flow of ink when the ink is circulated by a circulation-and-purging controller shown in FIG. 7.
Figure 10:
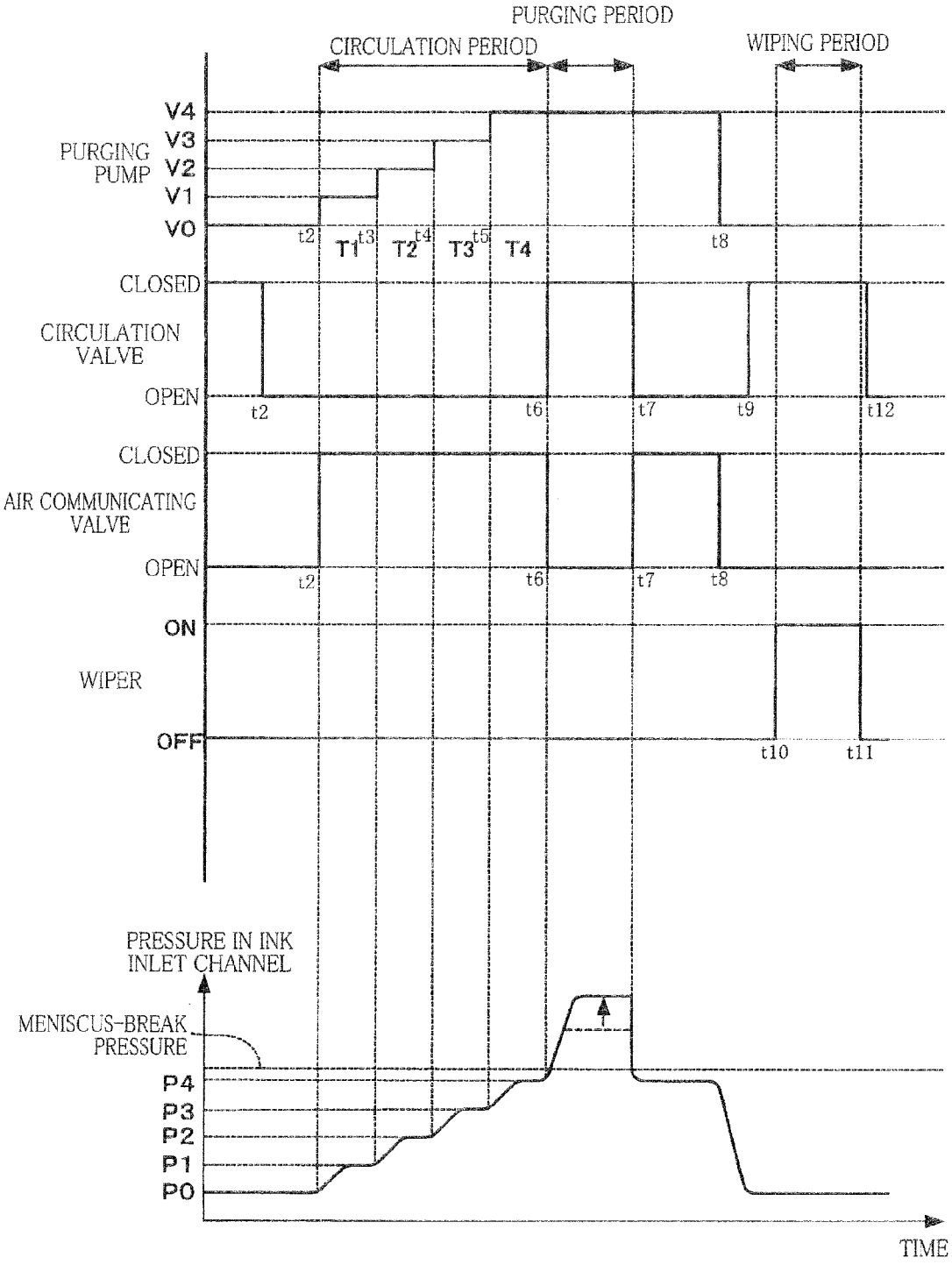
FIG. 10 is a view showing an operational sequence of the ink-jet printer shown in FIG. 1.

As shown in FIGS. 9 and 10, when the maintenance operation is started, the circulation-and-purging controller 44 opens the circulation valve 87 at a time t1 and then closes the air communicating valve 88 and drives the purging pump 86 at the same time at a time t2. It is noted that the replenish pump 91 is stopped, and the replenish valve 92 is closed during the maintenance operation.

As a result, the ink in the sub-tank 80 is forcibly supplied to the ink inlet channel 72 via the ink supply tube 82. Since the circulation valve 87 is open at this time, a channel resistance in a passage from the ink inlet channel 72 to the sub-tank 80 via the discharge channel 73 and the ink returning tube 83 is less than that in a passage from the ink inlet channel 72 to the ejection openings 108 via the ink outlet channels 75 and the manifold channels 105. Thus, the ink supplied to the ink inlet channel 72 passes through the discharge channel 73 and the ink returning tube 83 in order and returns to the sub-tank 80 (that is, the ink circulation is performed) without flowing into the ink outlet channels 75. When the ink circulation is performed, the pressure of the ink rises in a channel from the purging pump 86 to the sub-tank 80 in the circulation passage. Thus, by the ink flowing by the ink circulation, air bubbles and foreign matters remaining in the ink inlet channel 72, especially the air bubbles and the foreign matters built up on the filter 75*a*, are carried or transferred through the discharge channel 73 and the ink returning tube 83 in order together with the ink, so that the air bubbles and the foreign matters are trapped in the sub-tank 80.

During a circulation period in which this ink circulation is performed, the circulation-and-purging controller 44 controls the purging pump 86 such that the unit-time supply amount increases by a constant amount at each time when a predetermined length of time is elapsed from a point in time just after the driving of the purging pump 86 has been started. Specifically, the circulation-and-purging controller 44 controls the driving of the purging pump 86 such that the unit-time supply amount is V1 during a period T1 (first period) lasted for the predetermined length of time from the start of the driving, such that the unit-time supply amount is V2 which is larger than V1 by a specific amount during a period T2 lasted for the predetermined length of time from an end of the period T1 (at a time t3), such that the unit-time supply amount is V3 which is larger than V2 by the specific amount during a period T3 lasted for the predetermined length of time from an end of the period T2 (at a time t4), and such that the unit-time supply amount is V4 which is larger than V3 by the specific amount during a period T4 lasted for the predetermined length of time from an end of the period T3 (at a time t5, noted that the periods T1-T4 are the same length of time as one another). As a result, the pressure in the channel rises from P0 to P1 at the time t2, from P1 to P2 at the time t3, from P2 to P3 at the time t4, and from P3 to P4 at the time t5. It is noted that the periods T1-T4 constitute the circulation period.

Figure 11:
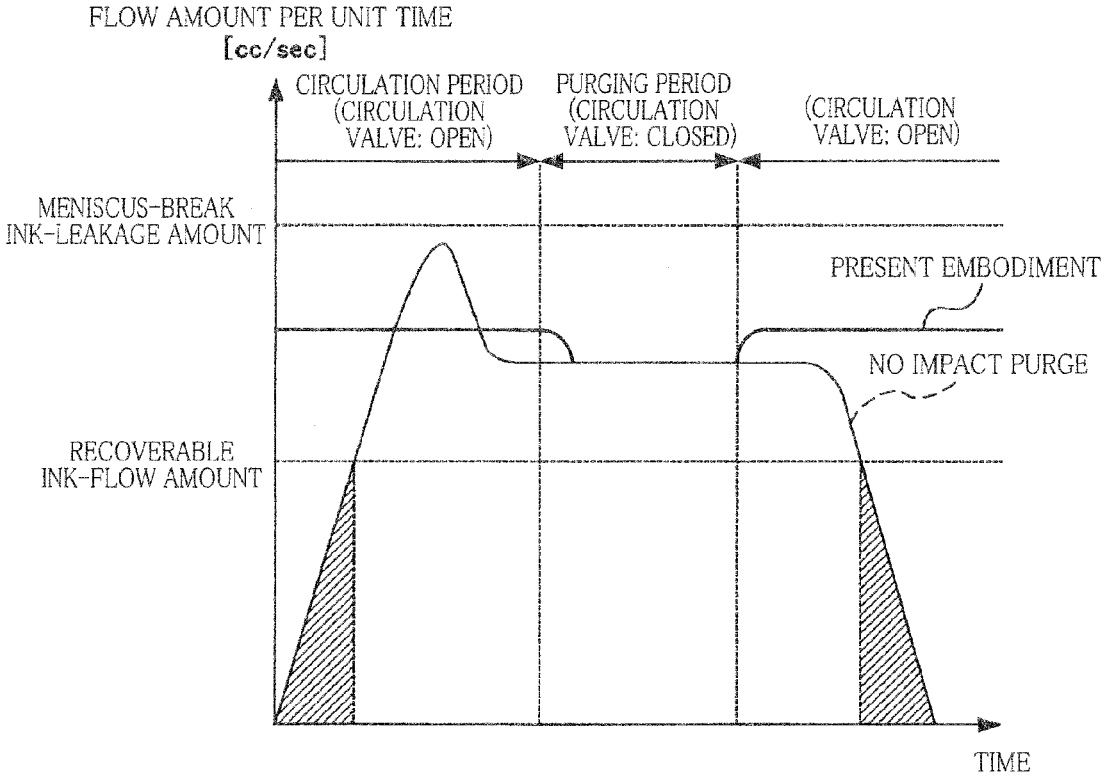
FIG. 11 is a graph showing a change of an ink-flow amount in a purging period shown in FIG. 10.

In order to efficiently move the air bubbles and the foreign matters to the sub-tank 80 by the ink circulation, the unit-time supply amount is preferably set at a relatively high amount in a range not higher than an amount (meniscus-break ink-leakage amount) of the ink at a timing when the ink starts to leak or flow from the ejection openings 108 by a break of meniscus (meniscus break) of the ink in the ejection openings 108 (see FIG. 11). It is noted that the meniscus-break ink-leakage amount is a value obtained by actual measurement or a value calculated from a channel structure of the ink-jet head 1, a height relationship between the ink-jet head 1 and the sub-tank 80 in the ink-jet printer 101, viscosity of the ink, and/or so on. The meniscus-break ink-leakage amount is stored in advance. From another point of view, where the driving of the purging pump 86 is started in the state in which the circulation valve 87 is closed such that the ink-flow amount is a recoverable ink-flow amount, an ink amount capable of discharging the air bubbles and the foreign matters remaining in the individual ink channels from all the ejection openings 108 together with the ink can be referred to as the recoverable ink-flow amount. That is, where the purging pump 86 is driven with the ink whose ink amount is less than the recoverable ink-flow amount, the ink may continue to be discharged only from ejection openings 108 respectively communicating with individual ink channels 132 containing relatively small amounts of air bubbles and thickened or viscous ink. In this case, even if a period for discharging the ink is made longer, the ink may not be discharged from all the ejection openings 108 together with the air bubbles and the foreign matters.

It is noted that the unit-time supply amount V1 is equal to or less than a half of the meniscus-break ink-leakage amount. Further, the unit-time supply amount V4 is less than the meniscus-break ink-leakage amount and equal to or greater than the recoverable ink-flow amount capable of discharging the air bubbles and the foreign matters remaining in the channel from the ejection openings 108 together with the ink when the ink is discharged from the ejection openings 108 in a purging operation which will be described below. The recoverable ink-flow amount is a value obtained by actual measurement.

Figure 12:
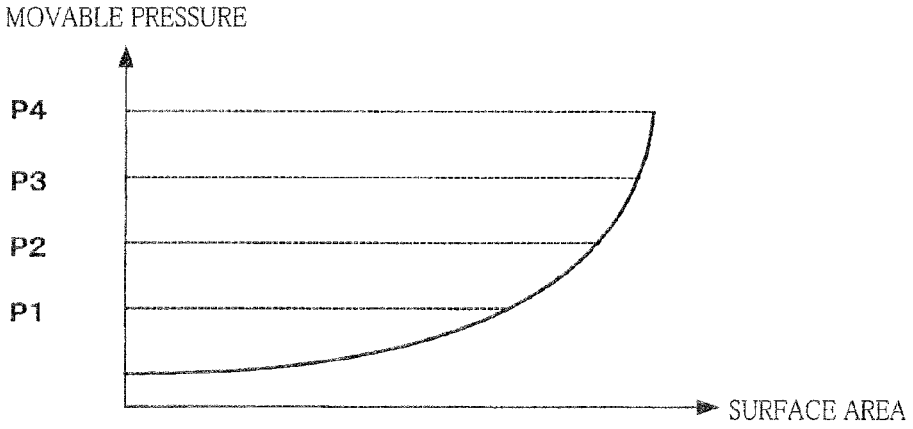
FIG. 12 is a graph showing a relationship between a surface area of an air bubble and a pressure in a channel which can move the air bubbles.

Here, where a size of the air bubble remaining in the channel becomes larger, a buoyancy of the air bubble becomes larger, so that a resistance force when the air bubble is moved downward becomes larger. Thus, as shown in FIG. 12, a pressure capable of moving the air bubble at a speed equal to or greater than a specific speed, i.e., the unit-time supply amount becomes larger exponentially in accordance with that the surface area of the air bubble becomes larger. Further, when the unit-time supply amount is changed, the flow of the ink is pulsated so as to change the pressure, thereby efficiently moving the air bubble. On the other hand, where the unit-time supply amount becomes larger than a specific amount, a flow separation phenomenon occurs in the channel, making it difficult for the ink to flow to corner parts of fine portions of the channel. Thus, the air bubble is trapped in the fine portions of the channel, which makes it difficult to move the air bubble. In such fine portions of the channel, a relatively small unit-time supply amount can sometimes flow the ink uniformly and move the trapped air bubble.

In the present embodiment, as shown in FIG. 10, the unit-time supply amount is increased stepwise from V1 to V4. Where the purging pump 86 is driven with the smallest unit-time supply amount V1, the air bubbles remaining in the fine portions in the channel can be moved to a main stream (flow) of the ink in the channel. The purging pump 86 is then driven with the unit-time supply amounts V2-V4 to raise the pressure in the channel, whereby the air bubble whose size has been made larger in the main stream of the ink in the channel can be moved by the flow of the ink. Further, the flow of the ink is pulsated to change the pressure in the channel at each time when the unit-time supply amount is changed from V1 to V2, from V2 to V3, and from V3 to V4, the air bubbles can be efficiently moved. It is noted that the main stream is a flow that has the highest speed of the flow of the ink among a plurality of flows in the channel.

It is noted that, as shown in FIG. 9, in the ink circulation, the ink pressures in the ink inlet channel 72 and the discharge channel 73 are relatively high when compared with in the normal recording, and accordingly the resin film 76 in the ink inlet channel 72 is held in close contact with the restraining member 77, and the resin film 78 in the discharge channel 73 is held in close contact with the restraining member 79.

In the period during which the air communicating valve 88 is closed in the ink circulation, a negative pressure is produced in the sub-tank 80. Thus, the ink in the ink inlet channel 72 is sucked into the sub-tank 80 via the discharge channel 73, making it difficult for the ink to flow into the ink outlet channels 75 when compared with the case where the air communicating valve 88 is open. As a result, the pressure in the ink inlet channel 72 is lowered, causing less meniscus break. Thus, when compared with the case where the air communicating valve 88 is open, the unit-time supply amount can be made larger until the pressure in the ink inlet channel 72 becomes closer to a pressure (meniscus-break pressure) at which the meniscus is broken. That is, assuming that the pressure in the ink inlet channel 72 is constant during the circulation, where the air communicating valve 88 is closed, the ink-flow amount is larger in the case where the air communicating valve 88 is open. Further, where the air communicating valve 88 is closed, the pressure in the ink inlet channel 72 during the purging period can be made larger than in the case where the air communicating valve 88 is open. Accordingly, it is possible to efficiently discharge the air bubbles and the foreign matters remaining in the individual ink channels from the ejection openings 108 together with the ink. In the present embodiment, the unit-time supply amount V4 in the period T4 is an amount during the ink circulation that is larger than a maximum amount in which the ink does not leak from the ejection openings 108 per unit time where the air communicating valve 88 is open and that is equal to or less than a maximum amount in which the ink does not leak from the ejection openings 108 per unit time where the air communicating valve 88 is closed. It is noted that, in FIG. 10, a solid-line waveform and a broken-line waveform indicate pressure changes in the ink inlet channel 72, specifically, the solid-line waveform indicates the pressure changes in the channel where the unit-time supply amount is made larger as described above in the state in which the air communicating valve 88 is closed during the ink circulation (i.e., in the case of the present embodiment), and the broken-line waveform indicates the pressure changes in the channel where the air communicating valve 88 is open during the ink circulation (noted that the unit-time supply amount is not made larger).

When the unit-time supply amount of the purging pump 86 has been stabilized at V4 in the period T4 of the circulation period, the purging operation is started at a time t6. When the purging operation is started, as shown in FIGS. 10 and 11, the circulation-and-purging controller 44 closes the circulation valve 87 and opens the air communicating valve 88 at the same time. As a result, the ink supplied to the ink inlet channel 72 flows into the ink outlet channels 75 without flowing into the discharge channel 73, and then the ink passes through the manifold channels 105 and the individual ink channels 132 in order and is discharged from the ejection openings 108. The discharged ink is received by a waste-ink tray, not shown.

Since the purging operation is started in the state in which the unit-time supply amount V4 is stable at the amount equal to or greater than the recoverable ink-flow amount as described above, the ink pressure in the ink inlet channel 72 is relatively high from a point in time just after the purging operation is started, whereby the thickened ink in the ejection openings 108 and the remaining air bubbles and foreign matters can be efficiently discharged from the ejection openings 108 (noted that this purging operation may be hereinafter referred to as "impact purge"). If the impact purge is not performed, that is, if the purging pump 86 starts to be driven in the state in which the circulation valve 87 is closed without circulating the ink, to discharge the ink from the ejection openings 108 (a conventional technique), the ink is needlessly discharged from the ejection openings 108 until the unit-time supply amount reaches the recoverable ink-flow amount. Further, in the above-described embodiment, the circulation valve 87 and the air communicating valve 88 are respectively closed and opened simultaneously. Thus, the pressure in the sub-tank 80 forcibly becomes the atmospheric pressure, thereby preventing the pressure in the sub-tank 80 from lowering in accordance with the discharging of the ink.

When a predetermined purging amount of the ink has been discharged from the ejection openings 108, the circulation-and-purging controller 44 stops the purging operation at a time t7 by opening the circulation valve 87 and closes the air communicating valve 88 at the same time again. It is noted that the predetermined purging amount is determined by the ink-flow amount of the purging pump 86 per unit time and a length of the purging period. The ink-flow amount per unit time and the length of the purging period for discharging the predetermined purging amount of the ink are obtained by experiment and stored in advance. The circulation-and-purging controller 44 makes the circulation period longer and the purging amount larger in accordance with increase in a temperature detected by a temperature sensor 35 or increase in a length of the elapsed time detected by the non-ejection-time detecting section 46.

Thereafter, the circulation-and-purging controller 44 stops the purging pump 86 and opens the air communicating valve 88 simultaneously at a time t8. At the same time, the head controller 43 stops supplying meniscus vibration signals to the actuator units 21. The circulation-and-purging controller 44 then closes the circulation valve 87 at a time t9.

As described above, by performing the ink circulation and the purging operation in order, the air bubbles and the foreign matters remaining in the ink inlet channel 72 can be discharged to an outside of the ink-jet heads 1 without flowing into the downstream-side channels (e.g., the manifold channels 105, the individual ink channels 132, and the like).

Then, when the wiping operation has been started at a time t10, the maintenance controller 45 moves the four ink-jet heads 1 upward by a moving mechanism, not shown, and then moves the four wiper members 32 in the main scanning direction along the ejection faces 2*a* respectively facing thereto while holding distal ends of the respective wiper members 32 in contact with the respective ejection faces 2*a*. This operation removes the excessive ink adhering to the ejection faces 2*a* by the purging operation and recovers or arranges the state of the ink meniscus formed in the ejection openings 108. After the ejection faces 2*a* have been wiped, the maintenance controller 45 returns the four wiper members 32 and the ink-jet heads 1 to their respective original positions, and the circulation-and-purging controller 44 opens the circulation valve 87, and the wiping operation is completed at a time t11.

As described above, according to the ink-jet printer 101 as the present embodiment, for the period T1 for which the ink circulation is started, the unit-time supply amount V1 is set at a relatively small amount to gather the air bubbles and the foreign matters scattered in corner parts of the channel to the main stream, and then the unit-time supply amount is changed to V2-V4 larger than V1 during the period T2-T4 to accelerate the ink flow, thereby moving the air bubbles and the foreign matters gathered in the main stream by and on the accelerated flow to discharge the air bubbles and the foreign matters to the outside from the ejection openings 108. As a result, even if the channel has complicated constructions and arrangements, it is possible to efficiently remove the air bubbles and the foreign matters remaining in the channel.

Further, since the unit-time supply amount is increased stepwise from V1 to V4 during the circulation period, the ink flow is accelerated at each time when the unit-time supply amount is changed (three times). As a result, it is possible to efficiently move the air bubbles and the foreign matters remaining in the channel.

At this time, the unit-time supply amount is increased stepwise by the constant amounts from V1 to V4. Accordingly, it is possible to stably move the air bubbles and the foreign matters staying in the fine portions having various forms.

Further, the electric power to be supplied to the purging pump 86 is changed, thereby controlling the unit-time supply amount of the purging pump 86. Accordingly, the unit-time supply amount can be controlled easily.

Further, the unit-time supply amount V1 during the period T1 is equal to or smaller than the half of the meniscus-break ink-leakage amount, ensuring reliable prevention of leakage of the ink from the ejection openings 108 during the period T1.

In addition, by performing the ink circulation, the pressure in the channel is made higher while removing the air bubbles and the foreign matters in the channel extending from the purging pump 86 to the sub-tank 80 in the circulation passage, and in this state, the circulation valve 87 is closed to start the purging operation. Accordingly, from the start of the purging operation, it is possible to discharge the ink from the ejection openings 108 in the state in which the pressure in the channel is relatively high. That is, if the purging operation is performed in a state in which air bubbles remain in the channel, the remaining air bubbles function as dampers for absorbing the pressure, which reduces efficiency of discharging the ink, but since the purging operation is started after the air bubbles in the channel are removed by the ink circulation in the above-described embodiment, it is possible to apply a relatively high pressure to all the ejection openings from the start of the purging operation, thereby efficiently discharging the thickened ink in the ejection openings 108, the air bubbles, and the foreign matters and preventing the ink from being discharged needlessly.

Further, the purging operation is started in the state in which the unit-time supply amount of the purging pump 86 is stabilized at V4, making it possible to discharge the ink stably from the ejection openings 108.

<Modifications>

Figure 13:
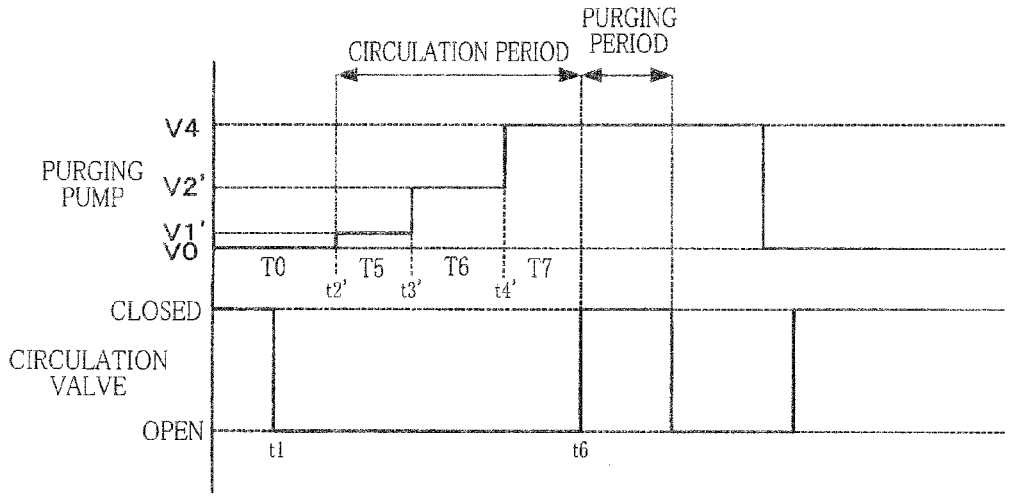
FIG. 13 is a view for explaining a first modification of the present embodiment.

There will be next explained modifications of the present embodiment. In the above-described embodiment, the circulation-and-purging controller 44 controls the purging pump 86 to increase the unit-time supply amounts V0-V4 equally during the circulation period. However, as shown in FIG. 13, the circulation-and-purging controller may control the purging pump 86 to discharge inks having unit-time supply amounts V0, V1', V2', V4 respectively corresponding to periods T0, T5, T6, and T7 and increased stepwise in this order such that each increasing amount is larger than a previous one. That is, the circulation-and-purging controller 44 controls the purging pump 86 to increase the unit-time supply amount from the amount V0 to the amount V1' at a time t2', from the amount V1' to the amount V2' at a time t3', from the amount V2' to the amount V4 at a time t4'. Where the printer 101 is configured in this manner, even if small air bubbles have been gathered in the channel so as to form a big air bubble which is hard to flow by the stream of the ink, such a big air bubble can be discharged because the acceleration of the ink flow is increased exponentially as time passes in the circulation period. It is noted that, in FIG. 13, the operation of the air communicating valve 88 is omitted, but the operation of the air communicating valve 88 is the same as in FIG. 10. For example, the air communicating valve 88 is closed from a time t1 to a time t6 in FIG. 13.

Figure 14:
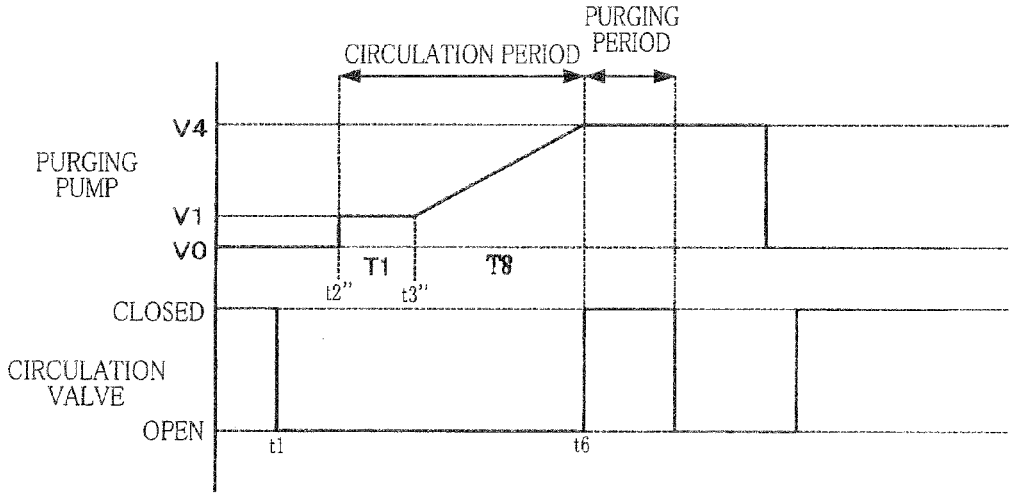
FIG. 14 is a view for explaining a second modification of the present embodiment.

As another modification, as shown in FIG. 14, the circulation-and-purging controller may control the purging pump 86 such that the unit-time supply amount is increased in proportion to the elapsed time after the period T1. That is, the circulation-and-purging controller 44 controls the purging pump 86 to increase the unit-time supply amount from the amount V0 to the amount V1' at a time t2" and to start to increase the unit-time supply amount at a time t3" in proportion to an elapsed time from the time t2" so as to reach the amount V4 at a time t6. Where the printer 101 is configured in this manner, the unit-time supply amount continues to be continuously increased after the period T1, thereby efficiently discharging the air bubbles and the foreign matters remaining in the channel to the outside by the accelerated ink flow. In this case, a period (T8) during which the unit-time supply amount is increased in proportion to the elapsed time is set at any period as long as the period falls within a period from the end of the period T1 to the beginning of the purging period. For example, the unit-time supply amount may be increased from V1 to V4 in proportion to the elapsed time during a period from the end of the period T1 to a point before the beginning of the purging period by a specific length of time, and then may be constant at V4 from the point at which the unit-time supply amount has been increased to V4 to the beginning of the purging period. It is noted that, in FIG. 14, the operation of the air communicating valve 88 is omitted, but the operation of the air communicating valve 88 is the same as in FIG. 10. For example, the air communicating valve 88 is closed from a time t1 to a time t6 in FIG. 14.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, the ink circulation is performed followed by the purging operation in the maintenance operation, but only the ink circulation may be performed without performing the purging operation. In this case, the ink supply unit may not include the circulation valve 87.

Further, in the above-described embodiment, the unit-time supply amount during the period T1 as the first period is smaller than the unit-time supply amount in a second period after the first period in the circulation period. In this case, the second period is at least one of the periods T2-T4. The second period may not be continuous to at least one of the first period and the purging period. Further, where the period T1 is defined as the first period, the purging period after the first period may be defined as the second period. As shown in FIGS. 10, 13, and 14, the unit-time supply amount in the first period is less than that in the second period (the purging period). Further, the period T2 or T3 in FIG. 10 may be defined as the first period, and in this case the period T4 may be considered as the second period, and the purging period may be considered as the second period. Further, the periods T1 and T2 may be collectively defined as the first period, and in this case the period T4 may be defined as the second period. In this case, the unit-time supply amount in the first period may be considered as an average value of the unit-time supply amounts of the periods T1 and T2.

In addition, in the above-described embodiment, the unit-time supply amount in the circulation period is increased stepwise or continuously from the end of the period T1 but may be reduced for a part of the period after the period T1.

Further, in the above-described embodiment, the unit-time supply amount V1 during the period T1 is equal to or smaller than the half of the meniscus-break ink-leakage amount, but the unit-time supply amount V1 during the period T1 may exceed the half of the meniscus-break ink-leakage amount. In this case, where an amount of the ink leaking from the ejection openings 108 in the ink circulation is very small, the ink-flow amount may be equal to or larger than the meniscus-break ink-leakage amount. For example, where the ink is leaking from only a small number of the ejection openings, the meniscus break occurs in the ejection openings, but an amount of the leaking ink is so small that effects for preventing the ink from being consumed needlessly can be obtained as a whole.

Further, in the above-described embodiment, the circulation valve 87 is provided on the ink returning tube 83, but the circulation valve may be provided on the discharge channel 73 at a position in a predetermined area from the outlet opening 73*a* to adjust the channel resistance value of the discharge channel 73. Where the printer 101 is configured in this manner, the circulation valve is positioned near the ejection openings 108, making it possible to quickly start discharging the ink from the ejection openings 108 in the purging operation. It is noted that the term "in the predetermined area from the outlet opening 73*a*" means an area from the outlet opening 73*a* to a position at which the discharge channel 73 is branched from the ink inlet channel 72.

Further, in the above-described embodiment, the circulation valve 87 is selectively opened or closed, but a resistance controlling valve capable of adjusting the channel resistance value at any value may be employed as the circulation valve 87. In this case, the resistance controlling valve may change the channel resistance value so as to change the channel resistance value stepwise or continuously. Further, the circulation valve 87 does not need to close the ink channel completely. Further, in the above-described embodiment, the channel resistance value of the ink returning tube 83 is adjusted by controlling the circulation valve 87 so as to reduce a cross-sectional area of the ink channel of the ink returning tube 83, but, in order to adjust the channel resistance value of the ink returning tube 83, an outer circumferential face of the ink returning tube 83 may be pinched by a pinching member to deform the ink returning tube 83 so as to reduce the cross-sectional area of the ink channel of the ink returning tube 83.

Further, in the above-described embodiment, the purging pump 86 is provided by the three-phase diaphragm pump as one of the volume pumps, but may be another volume pump such as a tube pump and may be a pump other than the volume pump such as an impeller pump. Further, the purging pump 86 may not be a motorized pump.

Further, in the above-described embodiment, the meniscus of the ejection openings 108 is vibrated during the circulation period and the purging period but may not be vibrated during at least a part of the periods. Where the printer 101 is configured in this manner, the meniscus-break ink-leakage amount is smaller than that in the above-described embodiment. Thus, the ink-flow amount of the purging pump 86 per unit time is preferably set at an amount smaller than the meniscus-break ink-leakage amount of this modification.

Further, in the above-described embodiment, each actuator unit 21 is provided by the unimorph piezoelectric actuator, but the actuator unit may be constituted by bimorph piezoelectric actuators. Further, the present invention may be applied to a thermal liquid ejection apparatus including heating elements.

The present invention is applicable to a liquid ejection apparatus configured to eject liquid other than the ink. Further, the present invention is applicable to a facsimile machine, a copying machine, and the like, in addition to the printer.

What is claimed is:

1. A liquid ejection apparatus comprising:

a liquid ejection head including:

an inlet opening into which liquid flows;

an outlet opening from which the liquid having flowed into the inlet opening flows;

an inside channel communicating the inlet opening and the outlet opening with each other; and a plurality of ejection openings through which is ejected the liquid having flowed through a plurality of individual channel branched from the inside channel;

a tank storing the liquid to be supplied to the liquid ejection head;

a supply channel communicating the tank and the inlet opening with each other;

a return channel communicating the tank and the outlet opening with each other;

a supply device configured to supply the liquid in the tank to the inside channel via the supply channel; and a controller configured to control the supply device, wherein the controller is configured to control the supply device to perform a circulating operation in which the liquid in the tank is transferred to the supply channel, the inside channel, and the return channel in order and returns to the tank, wherein the controller is configured to control the supply device such that a unit-time supply amount that is an amount of the liquid to be supplied to the inside channel per unit time in a first period in the circulating operation is the least unit-time supply amount in the circulation operation, and such that a unit-time supply amount in a second period in the circulating operation is the largest unit-time supply amount in the circulation operation, wherein an entire period of the circulation operation is divided into a plurality of periods, the beginning period of the plurality of periods is the first period, and the last period of the plurality of periods is the second period, wherein the controller is configured to control the supply device such that the unit-time supply amount in the circulation operation is increased stepwise from the unit-time supply amount in the first period, and wherein the controller is configured to control the liquid pressure in the supply channel and the return channel such that the liquid pressure in the first period is the least liquid pressure in the circulation operation, and such that the liquid pressure in the second period is the largest liquid pressure in the circulation operation.

2. The liquid ejection apparatus according to claim 1, wherein the controller is configured to control the supply device such that the unit-time supply amount is constant over the entire first period and such that the unit-time supply amount is constant over the entire second period.

3. The liquid ejection apparatus according to claim 2, wherein the second period is a period continuous from the first period.

4. The liquid ejection apparatus according to claim 1, wherein the controller is configured to control the supply device such that the unit-time supply amount is increased by a constant amount in each step.

5. The liquid ejection apparatus according to claim 1, wherein the controller is configured to control the supply device such that an amount by which the unit-time supply amount is increased stepwise is increased such that the amount in each step is larger than that in a previous step.

6. The liquid ejection apparatus according to claim 1, wherein the controller is configured to control the supply device so as to provide a period in which the unit-time supply amount in the circulating operation increases in proportion to an elapsed time from an end of the first period.

7. The liquid ejection apparatus according to claim 1, wherein the supply device includes a motorized pump provided on the supply channel, and wherein the controller is configured to control the unit-time supply amount by changing an electric power to be supplied to the supply device.

8. The liquid ejection apparatus according to claim 1, wherein the controller is configured to control the supply device such that the unit-time supply amount in the first period is equal to or less than a half of a maximum amount in a range in which the liquid does not leak from the ejection openings.

9. The liquid ejection apparatus according to claim 1, further comprising an adjustment device configured to adjust a channel resistance value in the return channel between a predetermined minimum value and a predetermined maximum value, wherein the controller is configured to perform the circulating operation (i) by controlling the adjustment device to adjust the channel resistance value such that the channel resistance value is smaller than the predetermined maximum value and (ii) by driving the supply device in the state in which the channel resistance value is smaller than the predetermined maximum value, wherein the controller is configured to perform a liquid discharge operation by controlling the adjustment device in the second period to increase the channel resistance value such that the liquid is discharged from the plurality of the ejection openings, and wherein the controller is configured to perform a liquid-discharge stopping operation by controlling the adjustment device during the liquid discharge operation to decrease the channel resistance value such that the discharge of the liquid from the plurality of the ejection openings is stopped.

10. The liquid ejection apparatus according to claim 9, wherein the second period is a period extending until the channel resistance value starts to increase for discharging the liquid from the plurality of the ejection openings, and wherein the controller is configured to control the supply device such that the unit-time supply amount is constant over the entire second period.

11. The liquid ejection apparatus according to claim 1, wherein the controller is configured to control the supply device such that the unit-time supply amount at the beginning of each of the plurality of periods is increased from that of the previous period, and such that the unit-time supply amount is constant over said each of the plurality of periods, wherein the controller is configured to control the liquid pressure in the supply channel and the return channel such that the liquid pressure is not decreased during the circulation operation.

12. A liquid ejection apparatus comprising:

a liquid ejection head including:

an inlet opening into which liquid flows;

an outlet opening from which the liquid having flowed into the inlet opening flows;

an inside channel communicating the inlet opening and the outlet opening with each other; and a plurality of ejection openings through which is ejected the liquid having flowed through a plurality of individual channel branched from the inside channel;

a tank storing the liquid to be supplied to the liquid ejection head;

a supply channel communicating the tank and the inlet opening with each other;

a return channel communicating the tank and the outlet opening with each other;

a supply device configured to supply the liquid in the tank to the inside channel via the supply channel; and a controller configured to control the supply device, wherein the controller is configured to control the supply device to perform a circulating operation in which the liquid in the tank is transferred to the supply channel, the inside channel, and the return channel in order and returns to the tank, and wherein the controller is configured to control the supply device such that a unit-time supply amount that is an amount of the liquid to be supplied to the inside channel per unit time in a first period in the circulating operation is less than that in a second period that is after the first period, wherein the controller is configured to control the supply device such that the unit-time supply amount is set to a first liquid supply amount over the entire first period, such that the unit-time supply amount is set to a second liquid supply amount over the entire second period, and such that the unit-time supply amount is set to a third liquid supply amount over an entire third period that is after the second period, and wherein a difference between the second liquid supply amount and the first liquid supply amount is the same as a difference between the third liquid supply amount and the second liquid supply amount.

13. The liquid ejection apparatus according to claim 12, wherein the second period is a period continuous from the first period, and the third period is a period continuous from the second period.

14. The liquid ejection apparatus according to claim 12, wherein lengths of the first period, the second period, and the third period are the same as one another.

15. A liquid ejection apparatus comprising:

a liquid ejection head including:

an inlet opening into which liquid flows;

an outlet opening from which the liquid having flowed into the inlet opening flows;

an inside channel communicating the inlet opening and the outlet opening with each other; and a plurality of ejection openings through which is ejected the liquid having flowed through a plurality of individual channel branched from the inside channel;

a tank storing the liquid to be supplied to the liquid ejection head;

a supply channel communicating the tank and the inlet opening with each other;

a return channel communicating the tank and the outlet opening with each other;

a supply device configured to supply the liquid in the tank to the inside channel via the supply channel; and a controller configured to control the supply device, wherein the controller is configured to control the supply device to perform a circulating operation in which the liquid in the tank is transferred to the supply channel, the inside channel, and the return channel in order and returns to the tank, and wherein the controller is configured to control the supply device such that a unit-time supply amount that is an amount of the liquid to be supplied to the inside channel per unit time in a first period in the circulating operation is less than that in a second period that is after the first period, wherein the controller is configured to control the supply device such that the unit-time supply amount is set to a first liquid supply amount over the entire first period, such that the unit-time supply amount is set to a second liquid supply amount over the entire second period, and such that the unit-time supply amount is set to a third liquid supply amount over an entire third period that is after the second period, and wherein a difference between the third liquid supply amount and the second liquid supply amount is greater than a difference between the second liquid supply amount and the first liquid supply amount.

16. The liquid ejection apparatus according to claim 15, wherein the second period is a period continuous from the first period, and the third period is a period continuous from the second period.

* * * * *